United States Patent [19]

Daugherty

[11] Patent Number: 4,987,976

[45] Date of Patent: Jan. 29, 1991

[54] TELESCOPING PORTABLE LIFT

[75] Inventor: Andrew H. Daugherty, Hammond, Ind.

[73] Assignee: Vermette Machine Company, Inc., Hammond, Ind.

[21] Appl. No.: 880,123

[22] Filed: Jun. 30, 1986

[51] Int. Cl.[5] ..... B66B 9/20

[52] U.S. Cl. ..... 187/11; 187/9 R; 182/148; 16/331; 414/785

[58] Field of Search ..... 187/9 R, 9 E, 11, 1 R; 182/148, 17, 63; 414/785; 286/5.28, 47.13 R, 47.16, 47.17, 47.2, 38; 16/297, 331, 229, 230, 332

[56] References Cited

U.S. PATENT DOCUMENTS

| | | | |
|---|---|---|---|
| 1,328,874 | 1/1920 | Henault | 16/229 |
| 2,565,820 | 8/1951 | Machanic | 280/38 |
| 3,157,433 | 11/1964 | Davis | 16/332 X |
| 3,477,600 | 11/1969 | Sawyer | 414/785 X |
| 3,567,054 | 3/1971 | Emke | 414/785 X |
| 3,876,039 | 4/1975 | Bushnell | 187/11 |
| 3,957,137 | 5/1976 | Vermette | 187/11 |
| 4,015,686 | 4/1977 | Bushnell, Jr. | 187/11 X |
| 4,131,181 | 12/1978 | Vermette | 187/11 |
| 4,194,591 | 3/1980 | Fisher | 182/17 |
| 4,395,188 | 7/1983 | Kaup | 414/785 X |
| 4,421,209 | 12/1983 | Vermette et al. | 187/11 |
| 4,458,785 | 7/1984 | Bushnell, Jr. | 187/9 E |

FOREIGN PATENT DOCUMENTS

| | | | |
|---|---|---|---|
| 743797 | 10/1966 | Canada | 187/11 |
| 151236 | 3/1932 | Switzerland | 16/331 |

*Primary Examiner*—H. Grant Skaggs
*Assistant Examiner*—Steve Reiss
*Attorney, Agent, or Firm*—Richard G. Kinney

[57] ABSTRACT

A manually-operated portable lift which may telescopically raise its mast or post so as to raise a lifting platform above the lift's initial height. The lift may be folded up to a compact and easily-moved configuration for ease of transport and storage. The lift includes a base with built-in outriggers which can be easily snapped out to fixed extended positions and returned to their storage positions. The outrigger is automatically latched in either such position but not between them. The base portion forward of the post can be manually unlatched and folded up parallel to the post. The platform and its arms have provision for manually mounting the arms of the platform in a low lifting position, a high lifting position, and a compact storage position wherein the arms are adjacent the platform. An extension mast is provided in either a storage position adjacent the main mast or as an extension of that mast. A manual winch is provided with dual handles—one long and one short—for greater or lesser mechanical advantage and slower or faster operation.

7 Claims, 11 Drawing Sheets

TELESCOPING PORTABLE LIFT

FIELD OF THE INVENTION

The present invention is directed to a new and improved portable lift. (U.S. Class 187/11)

BACKGROUND OF THE INVENTION

Portable lifts are widely used in industry and construction for many lifting operations. The lift of the present invention is a hand-propelled and manually-powered lift, useful in lifting loads of the order of 500 to 1,000 pounds, although with heavier duty components, it can be used with greater loads. Lifts of this general type are disclosed in U.S. Pat. No. 3,957,137, entitled PORTABLE MATERIAL LIFT, issued to Howard H. Vermette; in U.S. Pat. No. 4,131,181, entitled PORTABLE LIFT, issued to Howard H. Vermette; and in U.S. Pat. No. 4,421,209, entitled LIFT APPARATUS and issued to Howard H. Vermette and Andrew H. Daugherty, the present inventor. All of these patents are assigned to the assignee of the present invention.

A telescoping lift is disclosed in U.S. Pat. No. 3,876,039. Commercial telescoping lifts are available from Genie Industries and described in the pamphlet entitled, "Genie Lifting Tools for the Construction Trades", 1984, available from Genie Industries, 18340 N.E. 76th St., P.O. Box 69, Redmond, Wash., 98073, and in the manual, "Operators Manual Series 75 Lift", May, 1985, published by Sumner Manufacturing Co., Inc., 2900 DeSoto, Houston, Tex., 77091.

Despite the acknowledged utility of such prior lifts, they are often difficult to handle or to move (e.g., through doorways or into a van), and they are often time-consuming to set up for use.

SUMMARY OF THE INVENTION

A compactable, portable mechanical lift constructed in accordance with the present invention is of the type including a base having longitudinally-extending rail members with casters at the ends so that the lift can easily roll on its base; outriggers mounted to the outsides of the rails, so as to be pivoted from a storage position parallel and adjacent to the rails to an operational extended position wherein they can contact the surface and stabilize the lift; and a post assembly mounted on the base with a platform mounted on it for movement up and down the post assembly, and a winch assembly including a manually-powered winch and a cable connected thereto is provided, mounted at the rear of the post assembly for raising and lowering the platform and any load carried thereby. Means are provided in accordance with the present invention for compacting the lift for storage and moving it on its back, including folding base rail members and rear wheel means.

In accordance with one feature of the invention, the outriggers are constructed with a push-release mechanism which allows them to be latched and unlatched easily for pivoting between their storage positions and their operational positions and to automatically latch into such positions but not in between.

Thus, a portable lift is provided in accordance with the present invention which may be compactly folded up for storage or transportation and yet is easy and quick to set up and use.

The invention, together with the advantages thereof, may best be understood by reference to the following description taken in connection with the accompanying drawings, in the several figures of which, like reference numerals identify like elements.

DETAILED DESCRIPTION

Figure 1:
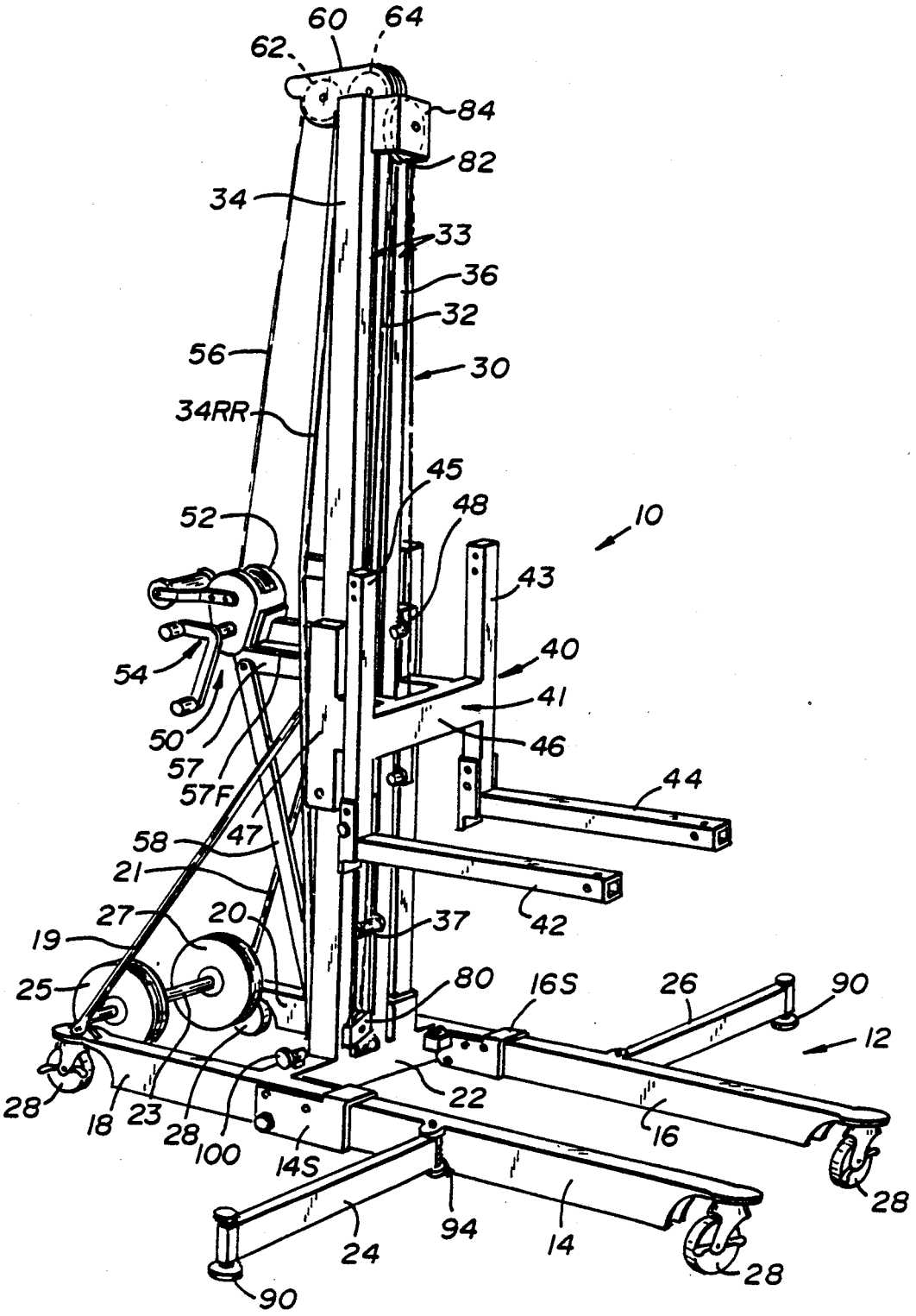
FIG. 1 is a perspective view of a telescoping portable lift constructed in accordance with the present invention, shown in its set-up position.

Referring to FIG. 1, there is depicted a lift 10 constructed in accordance with the principles of the present invention. The lift 10 is shown in its set-up operational configuration and includes a base portion 12. The base 12 includes a pair of novel spaced-apart, forward base side members or extension rails 14, 16 and a pair of rear base side members 18, 20. A base cross member 22 extends between the rear side members 18 and 20, to form an overall H shape to the base 12.

Also provided as part of the base 12 is a pair of outriggers 24, 26, whose novel construction and manner of attachment and use will be explained in more detail below. The base 12 includes lockable heavy-duty caster wheels 28, one at each corner, at the outer ends of the side base members 14, 16, 18, 20.

Mounted on the cross-member 22 of the base is a mast or post assembly, generally designated 30. Mounted for vertical movement on the front of the assembly 30 is a carriage or platform 40 which carries a pair of arms 42, 44. The arms 42, 44 normally receive the load to be raised.

A winch assembly 50 is provided, mounted to the rear of the post assembly 30. This assembly 50 includes a winch 52 which is manually driven by a novel handle unit 54. The winch 52 is provided with a cable 56 which leads to a pulley unit 60 mounted on the post assembly 30.

The cable 56 runs over a pair of pulleys 62, 64 contained in the housing 60 and down the front of the assembly 30 to and around a pulley 80 which is mounted to a portion of the post assembly 30. The cable 56 then runs up to a pulley 82 maintained in a pulley housing 84 and down again to the platform 40 where it turns again about a pulley 70 (FIGS. 15 and 16) and back up to the housing 84 where one end of cable 56 is secured at 85. For clarity in the drawings, the cable 56 between the pulleys 82, 80, and 70 is not shown in many of the figures.

When the lift 10 is as shown in FIG. 1, releasing of the winch 52 would spool out additional cable 56 and allow the platform 40 and any load on its arms 42, 44 to move downward by gravity. Cranking on the handle unit 54 would spool in the cable and raise the platform 40 and arms 42, 44.

Figure 2:
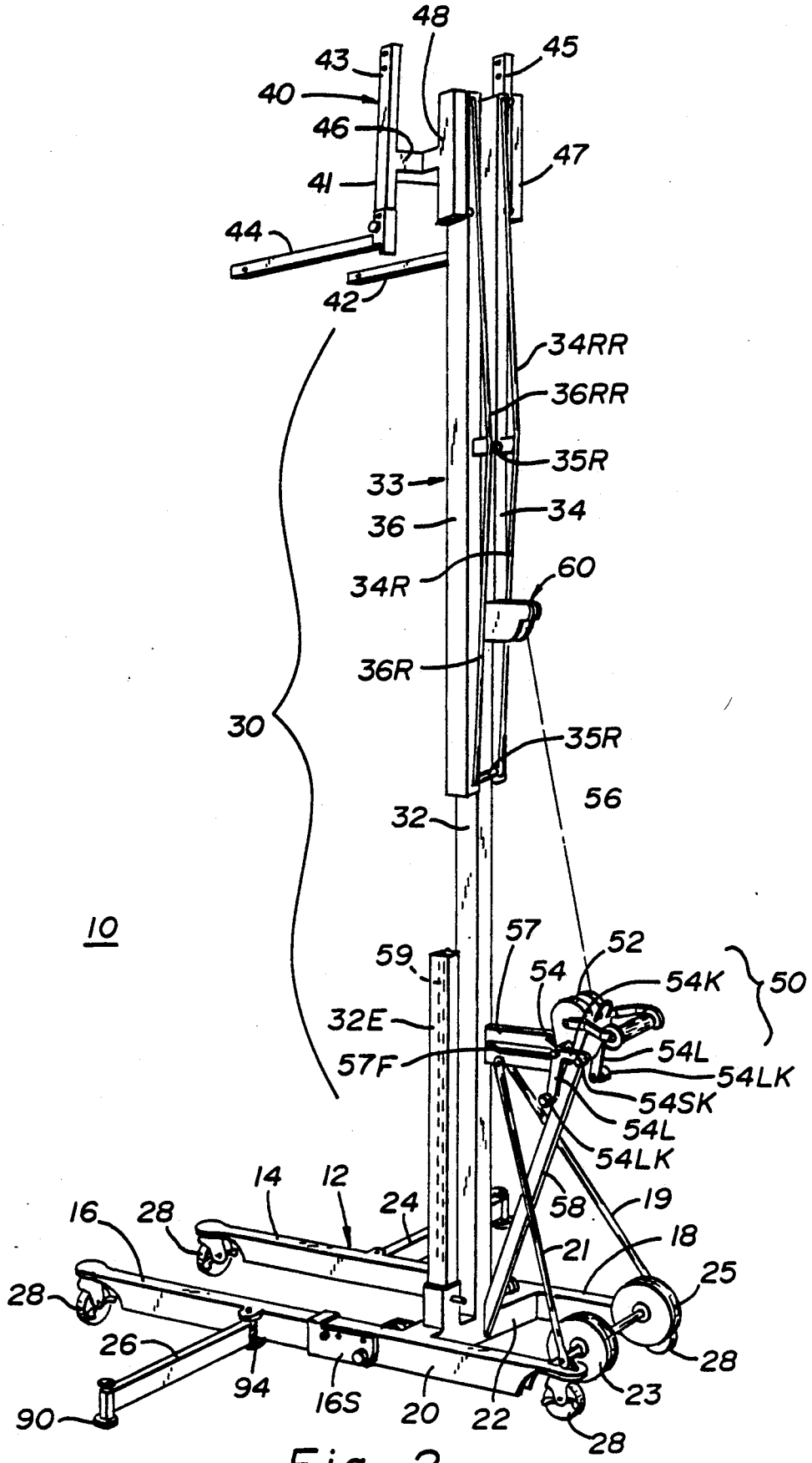
FIG. 2 is a perspective view of the lift of FIG. 1 as seen from a different angle, with parts in moved positions.

The post assembly 30 includes a main post 32 which is shown better in FIG. 2. The post 32 is affixed at its bottom to the cross-member 22. A telescoping post subassembly 33 is primarily composed of posts 34, 36 which are positioned one on either side of the main post 32 and mounted to move vertically upward, from their positions in FIG. 1 to those shown in FIG. 2.

The pulley 80 is secured to the bottom of the subassembly 33 and travels upward with it. Likewise, the pulley housing 84 is secured to the top of the subassembly 33 and also moves with it.

The posts 34, 36 are secured together by the housing for the pulley 80 and the pulley housing 84 which spans between them and across the main post 32. A number of brackets and rollers 35R, 37 (FIGS. 1, 2, 15, 16) are provided, mounted to and between the posts 34, 36, so as to roll against the front and back surfaces of the post 32. There are two rollers on the front of the unit 33 and three pairs of rollers on the back.

Applicant has discovered that by bracing the tubes 34, 36, as best shown in FIG. 2, the assembly 33 can be constructed of lightweight materials without excessive bending under a load and with a net saving of weight. The bracing is formed by steel rod sections 34R, 34RR, 36R, 36RR, each welded one end respectively to the top or bottom of the rear surface of the member 34, 36 and at their other ends to the centrally-projecting bracket for the center rear roller 35R. This provides triangular bracing and materially stiffens the assembly 33 from bending forwardly under a load.

From FIGS. 1 and 2, it can be appreciated that winching in the cable will initially raise the platform 40 up to the pulley housing 84. Further winching in of the cable 56 raises the telescoping subassembly 33 and the platform 40 together—with the platform 40 at the top of the subassembly 33. Continued winching in of the cable raises the subassembly 33 until stops (rollers 37 (FIGS. 1 and 6) make contact with the pulley housing 60.

Figure 3:
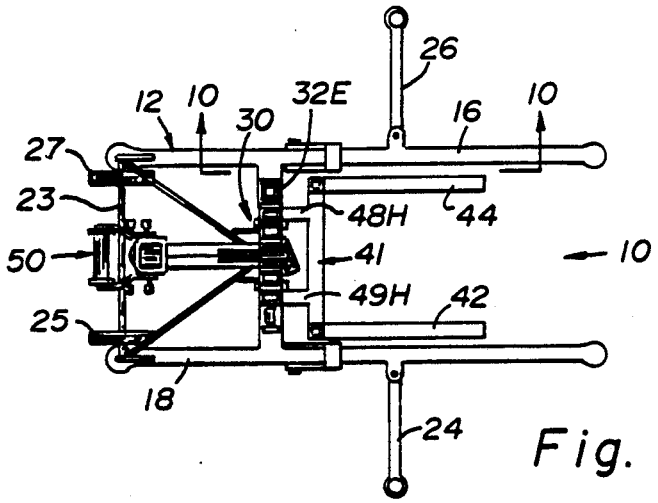
FIG. 3 is a top view of the lift of FIGS. 1 and 2.
Figure 15:
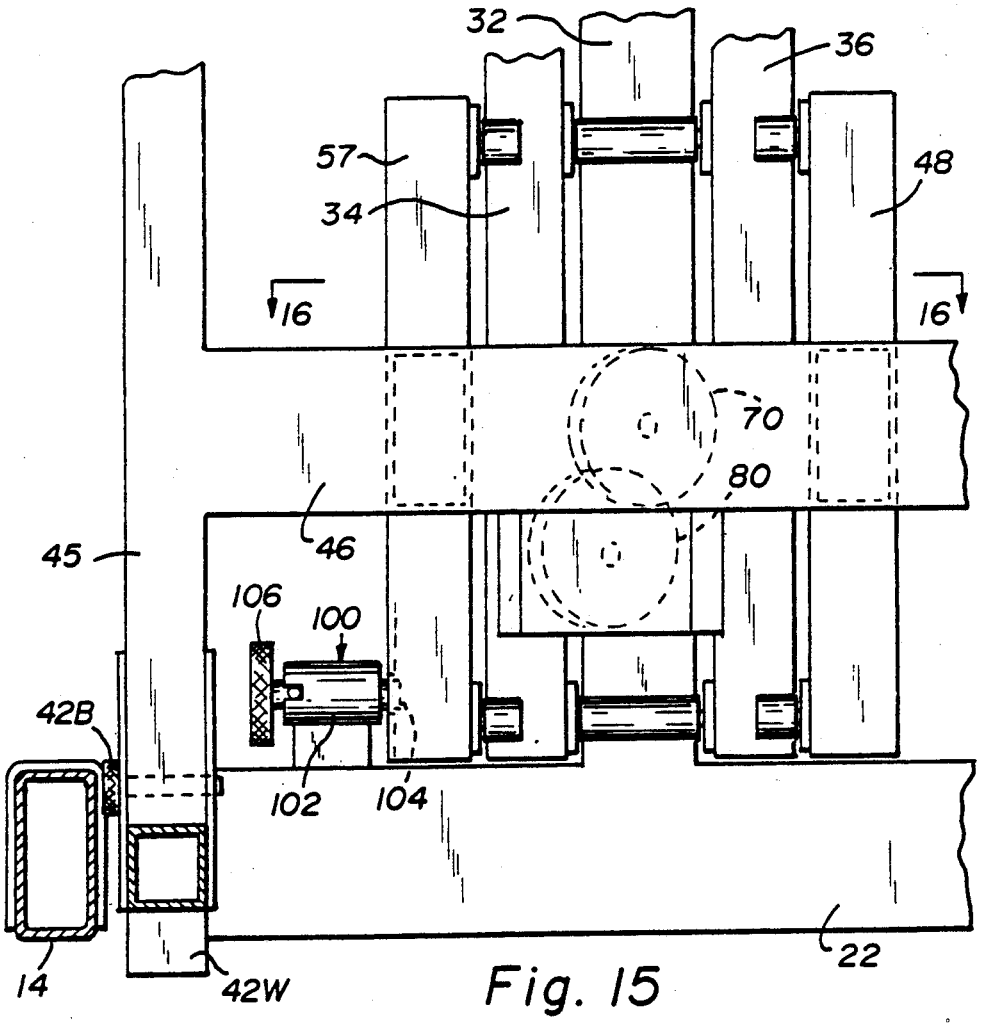
FIG. 15 is a partial elevational view, partly in section and with hidden parts shown in phantom outline, of the lift of FIGS. 1–14.
Figure 16:
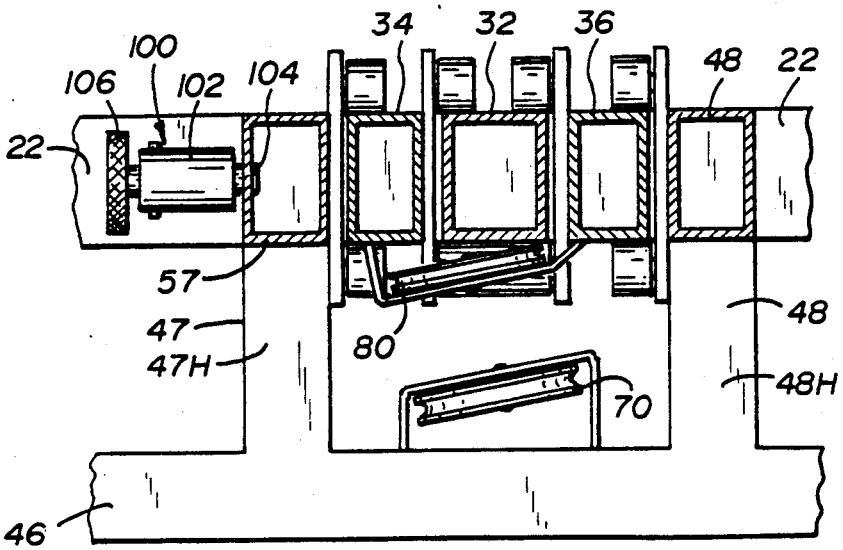
FIG. 16 is a sectional view of the portion of the lift illustrated in FIG. 15 as seen from the line 16—16 in that figure.

The platform assembly 40 includes, as is best shown in FIG. 1, a generally H-shaped front portion 41, two vertical members 43, 45, and a cross-member 46. Two T-shaped members 47, 48 (better shown in FIGS. 2, 3, 15, and 16) are affixed to the rear of the cross-member 46. These include short horizontal members 47H, 48H which project forward from the plane of main post member 32, as best shown in FIGS. 3 and 15. These cantilevered members 47H, 48H, together with the cross-member 46 of the H-assembly 41, surround the vertical cable runs between the pulleys 64, 80, 82, and 70, as best shown in FIG. 16. Note should be taken, again shown best in FIG. 16, of the angle and offset of pulleys 80 and 70. These, with the offset of the pulley 82, insure that the cable lengths between the pulleys are spaced apart from and parallel to one another. The platform 40 moves vertically relative to the posts 34, 36 and has rollers 40R on brackets to aid it in moving therealong and to hold it in place.

The winch assembly 50 includes a winch mounting bracket 57 affixed to the main post 32. The bracket 57 has a reinforcing or stiffening flange 57F on both sides of it. A support brace 58 is provided between the bottom of the main post 33 and the bracket 57.

Additional bracing for the winch bracket 56 and main post 33 is provided by a pair of braces 19 and 21 which are affixed at the rearward ends of members 18 and 20 respectively and run to the junction between the main post 33 and the bracket 56, as best shown in FIG. 2. The base members 18–20 also have a rear bracing rod 23 which also supports a spaced-apart pair of large-diameter, rubber-tired wheels 25, 27. (These wheels are off of the ground in the operational or set-up configuration of FIGS. 1–3 and take no part in the normal lifting operation. The function of these wheels will also be explained below.)

The winch handle unit 54, as best shown in FIG. 2 comprises two handles 54K and 54L with a single hub 54K. Each handle 54S and 54L has a freely rotatable knob 54SK, 54LK.

The raising of a load on the arms 42, 44 to beyond the top of the main post 32 adds the weight of the unit 33 to that which must be raised. The mechanical advantage to the operator can be improved by his switching his hands at this point from the short winch handle 54K (FIG. 1 or 2) to the longer handles 54L.

Figure 6:
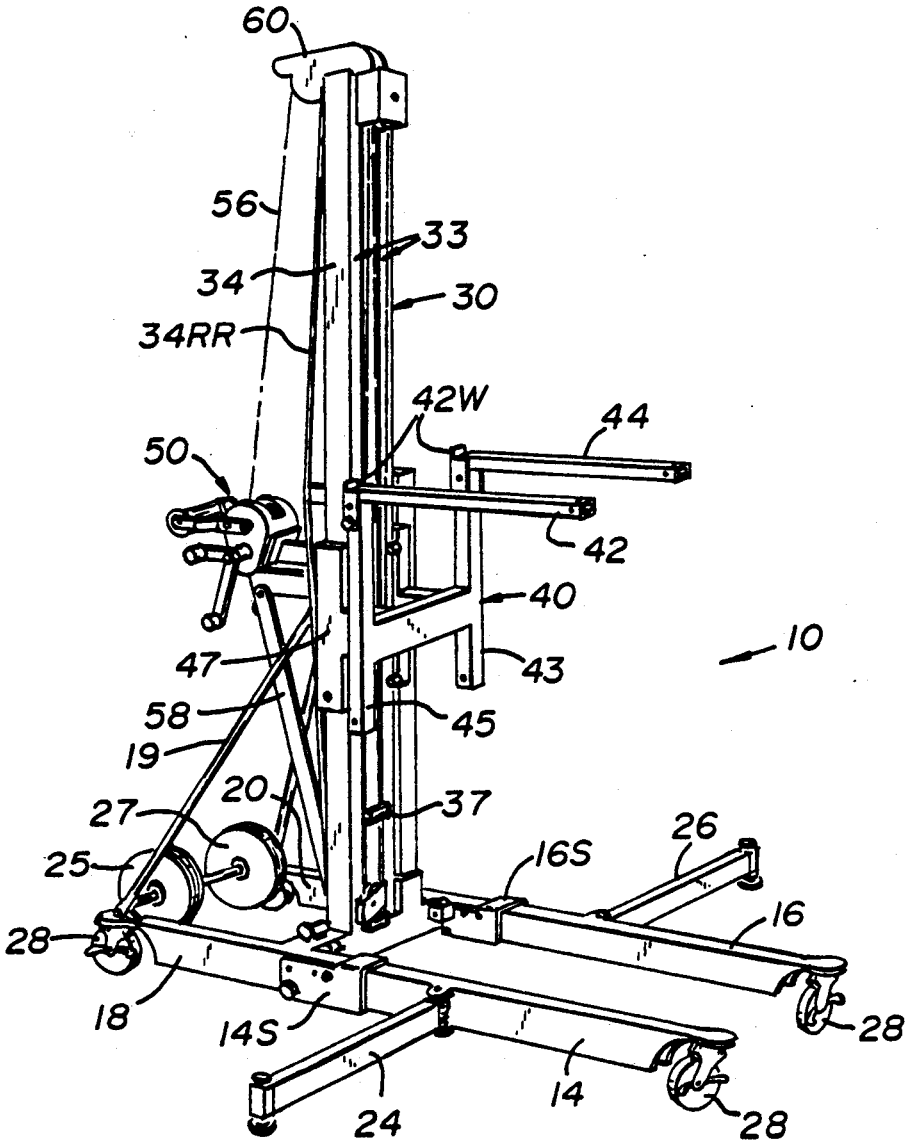
FIG. 6 is a perspective view of the lift of FIGS. 1–5, with parts shown in an alternative configuration.

Also shown in FIGS. 1–3 is an extension mast or post 32E. This post is shown in its normal storage position, held in a short sleeve mounted on the top surface of the base cross-member 22. This sleeve and the post 32E when in it are clear of the assembly 30, and arm members 48 of the platform 40 may freely move adjacent to it. This extension post 32E may be used to extend the effective length of the main post 32, as shown in FIG. 6. The method of assembly of this extension post 32E into the lifting mechanism will be explained later.

Multi-Position Arms

In FIGS. 1–3, the arms 42, 44 are secured to the bottom of the members 45, 43. This arrangement allows them to be lowered to the height of the base members 14 and 16 (between which they can fit, as can be appreciated best from FIGS. 3 and 15). When so lowered, loads can be easily rolled or slid onto them over the tops of base members 14, 16.

Figure 4:
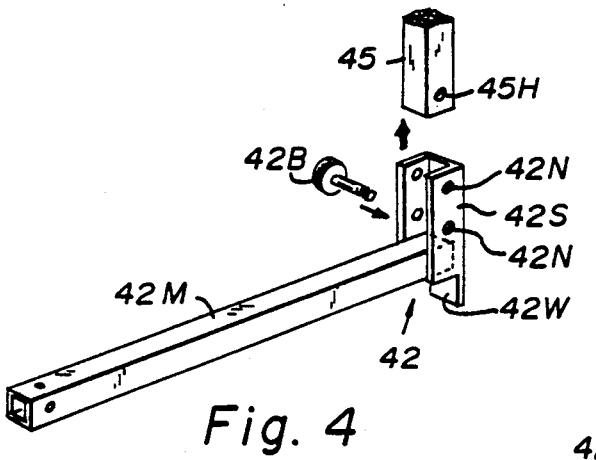
FIG. 4 is a perspective exploded view of a portion of the lift of FIGS. 1–3.

Each of the arms 42 and 44 are constructed identically, and only one will be described in detail, it being understood that the other is constructed and used in the same manner. As shown in FIG. 4, the arm 42 includes a main member 42M and a projecting channel 42S, to which it is securely welded or otherwise permanently affixed. The channel 42S fits over the bottom of the member 45 and surrounds it on the back, both sides, and bottom. The channel 42S has two holes formed on each side, which are aligned with one another and spaced. The top hole (as seen in FIG. 4) is positioned to be aligned with a matching hole 45H through the bottom of the member 45. The arm member 42 is releasably secured by bolt 42B which may be threadably received in a tapped hole 42N.

Figure 5:
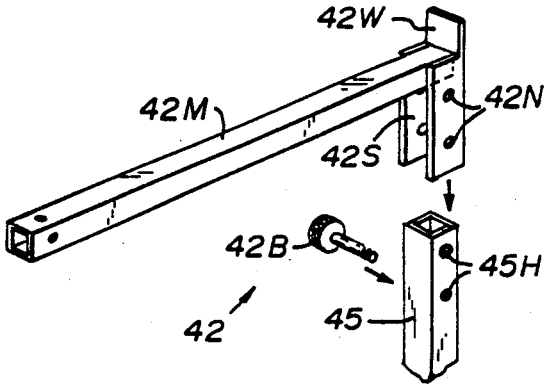
FIG. 5 is a perspective exploded view of one part of the lift of FIGS. 1–4 shown in an alternative position.

The arms 42, 44 may also be removed from the bottom of the vertical platform members 43, 45, turned over, and affixed at the top of the member, as shown in FIG. 5. This results in the arrangement of FIG. 6, wherein the load may be placed higher on the platform. Note the providing of projecting stop walls 42W which serve as a back stop for loads, or a container (e.g., a box), or for a load to be placed on the arms 42, 44 and easily positioned thereon.

Figure 7:
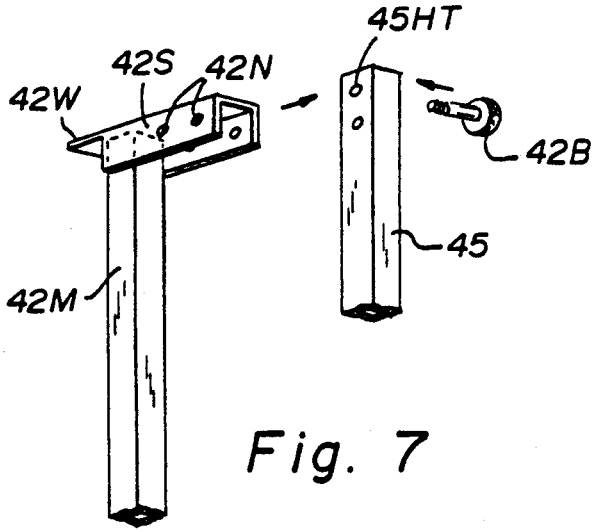
FIG. 7 is a perspective exploded view of certain parts of the lift of FIGS. 1–6, showing the manner of attaching a part thereto in an alternative storage configuration.

Not only may the arms 42, 44 be positioned as shown in FIGS. 1–4, or as in FIGS. 5 and 6, but they may also be secured to the platform members 43, 45 in a storage position, with the arm 42M parallel to and adjacent the member 43, as illustrated in FIG. 7. In this case, the bolt 42B goes through the top hole 45HT.

The Outriggers

Figure 14:
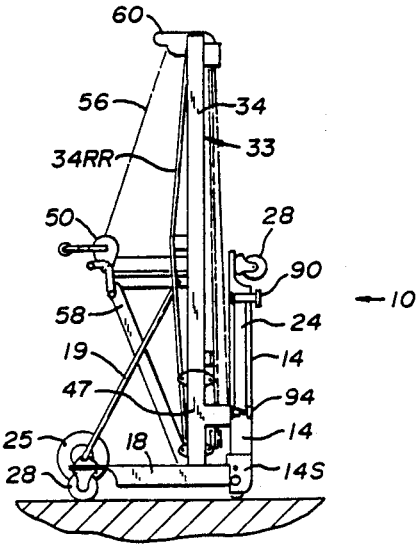
FIG. 14 is a side elevational view of the lift of FIGS. 1–13, secured for storage and movement.

The set-up lift 10, as shown, for example, in FIGS. 1 and 2, is equipped with outriggers 24, 26. These are each made identically, so only one will be described in detail, it being understood that the other is constructed in the same manner. The outriggers 24, 26 each include a lever foot 90, which is shown in detail in FIGS. 8 and 9. The foot 90 is manually-adjustable by turning a knurled nut 92 above the foot. The outrigger 24 is secured to the base member 14 of the base 12 by a novel swivel-pin mechanism 94 which allows the outrigger to be easily pivoted to a storage position adjacent the base member, as shown in FIG. 14.

This mechanism 94 includes a pair of flanges, a top flange 24F and a bottom flange 24G, which have respectively a square hole and a round hole in them and receive a pin 95 which extends between and through them. The pin 95 is generally square in cross-section at its top portion and of a round cross-section at its bottom length. The flanges 24F and 24G are loosely received between two flanges, a top flange 14F and a bottom flange 14G, which project from the member 14.

The pin 95 has a washer 96 seated against the shoulders formed between its round bottom portion and its square upper portion. This washer is held in place by a spring 97 which is compressed between it and the top of flange 24G. This spring also biases the pin 95 upward. The pin 95 is held in position by a washer 98 and snap ring 99 (in a groove formed in the pin 95) below the flange 14G. The top of the pin has a round extension 95E which serves as a "push button" to release the outrigger 24.

Figure 8:
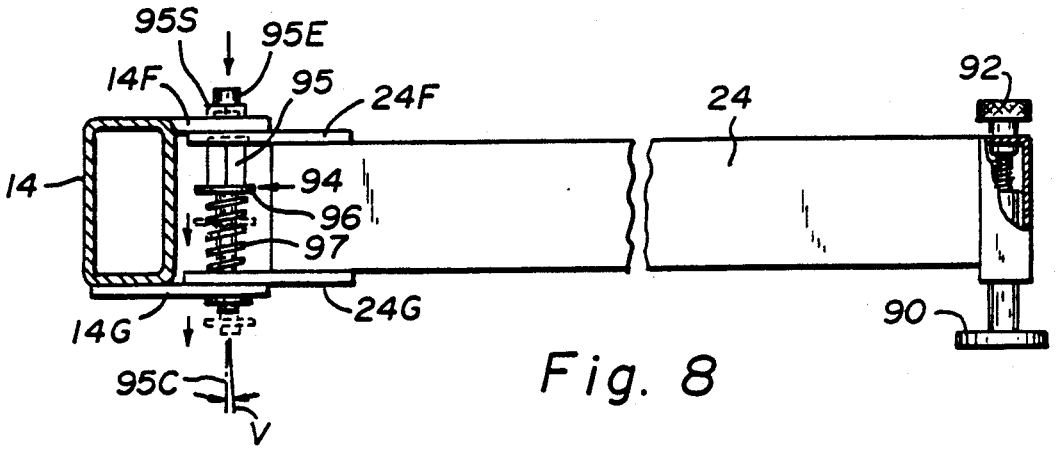
FIG. 8 is a fragmentary side view partly in section and partly broken away of a portion of the lift of FIGS. 1–7.
Figure 9:
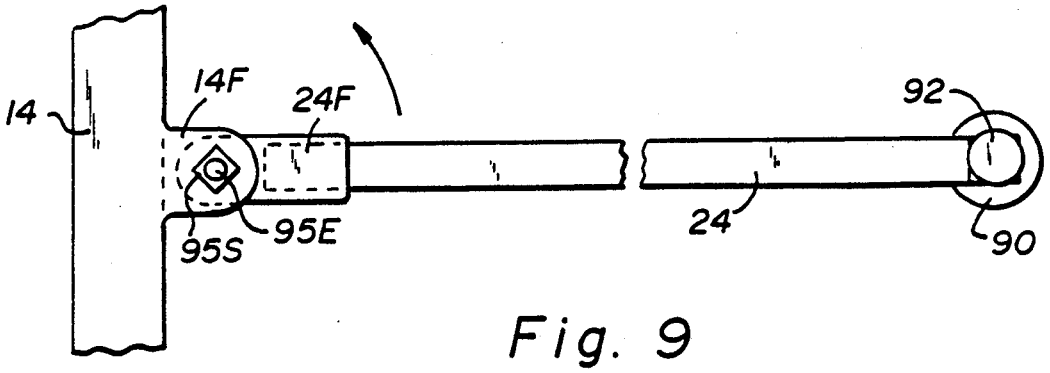
FIG. 9 is a top view of the partly broken-away portion of FIG. 8.

That is, depression of the pin 95 by pressing down the extension button 95E moves the pin downward, as shown by the arrows in FIG. 8. As soon as the shoulder 95S between the push-button portion 95E and the square portion of the pin 95 is lowered below the level of the bottom of the flange 14F, the outrigger 24 can be pivoted, as indicated by the arrows in FIG. 9. Once the outrigger is pivoted slightly, the button 95E may be released. The pin 95 will be held in its low position by the flange.

When the outrigger 24 reaches a position parallel to the member 14, the square section of the pin 95 has rotated 90 degrees, and the compressed spring snaps it automatically into the square hole in the flange 14F and latches the outrigger in the storage position.

Note should be made of the fact that the pivoting of the outrigger raises and lowers its foot 90. That is, as illustrated in FIG. 8, the center line 95C of the pin 95 is inclined to the vertical (line V) by a slight amount (preferably 3 degrees). This causes the end of the outrigger to rise up when it is pivoted to its storage position and move down when it returns to the active position (FIG. 8). Thus, on a flat surface, the swing out of the outriggers 24, 26 would automatically engage their feet 90 on the surface, and the reverse swing would disengage those feet.

When the outriggers are retracted into their storage positions and the caster wheels 28 unlocked, the lift 10 may be easily wheeled about on a jobsite and re-positioned for use at a new location by locking the wheels 28 and swinging out the outriggers 24, 26.

Compacting the Lift for Storage or Transportation

The lift 10, is mobile and capable of being moved about easily, and with the outriggers easily moved to their storage or retracted positions, may be wheeled through many doors. However, for going through low openings and for loading into, e.g., a panel truck, further novel provisions are provided, to make it even more compact and transportable.

These provisions include, in addition to retracting the outriggers 24, 26, the storage position for the arms 42, 44, already described above in connection with FIG. 7, and novel provisions for vertically folding the base members 14 and 16.

As shown in FIGS. 1, 2 and FIGS. 10, 11, 12, and 13, the base members 14 and 16 include sleeves 14S, 16S. As the sleeves 14S and 16S are mirror images of one another, only the sleeve 16S and associated parts as shown in detail in FIGS. 10–13 is described, it being understood that the construction and operation of the similar sleeve 14S will be substantially the same.

Figure 10:
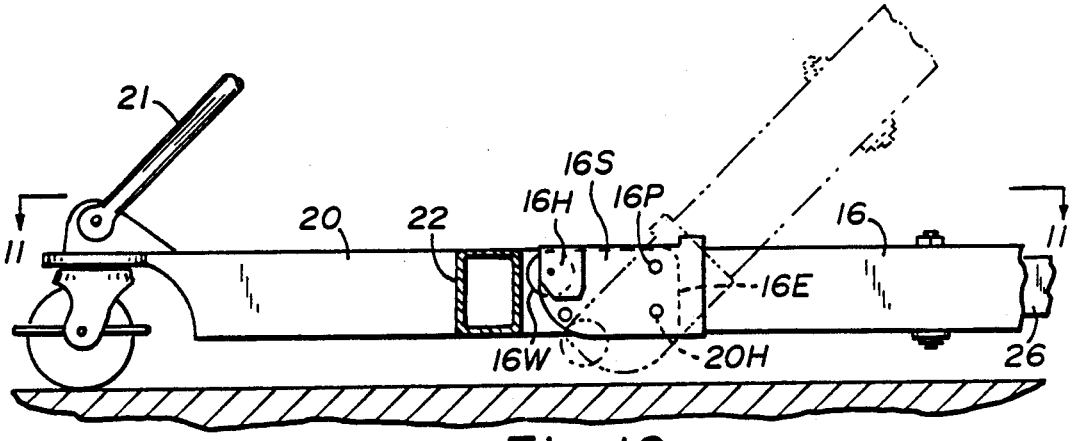
FIG. 10 is a partial elevational view of the lift of FIGS. 1–9, as seen from the line 10—10 in FIG. 3, partly in section and partly broken away, with a moved position shown in dashed outline.

As shown in FIGS. 10–13, the sleeve 16S surrounds the end 16E of the section of rectilinear tubing which forms the main length of the member 16. The sleeve is secured to it by welding or in a like permanent manner. The sleeve 16S may be formed from a section of rectilinear tubing sized to fit over the main tubing of the member 16 but has its top portion cut off where it would otherwise overlay the rear member 20. Thus, it forms a channel-like extension which surrounds the front portion of the member 20 when in the operational configuration (FIG. 10, solid lines). The sleeve 16S is secured to the member 20 by means of a pivot connection 16P and by a manually-removable bolt 16B, best shown in FIG. 11. The bolt 16B is received in aligned holes in one side of the sleeve 16S, through the member 20, and is threadably received in a threaded hole in the other side of the sleeve.

Figure 13:
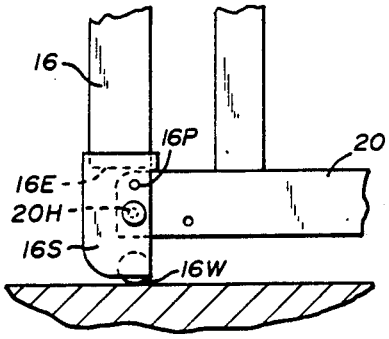
FIG. 13 is a detailed view of a portion of the lift parts in the configuration of FIG. 12, as seen from the line 13—13 of FIG. 11.

As shown in dashed lines in FIG. 10 and in FIG. 13, the member 16 may be pivoted up to a position more or less vertically parallel to the mast assembly 30. This can easily be done by removing the bolt 16B and pivoting the member 16 up. A second set of holes 20H is provided through the member 20, so that the bolt 16B can be secured through them to secure the member 16 in its vertical storage position.

Figure 11:
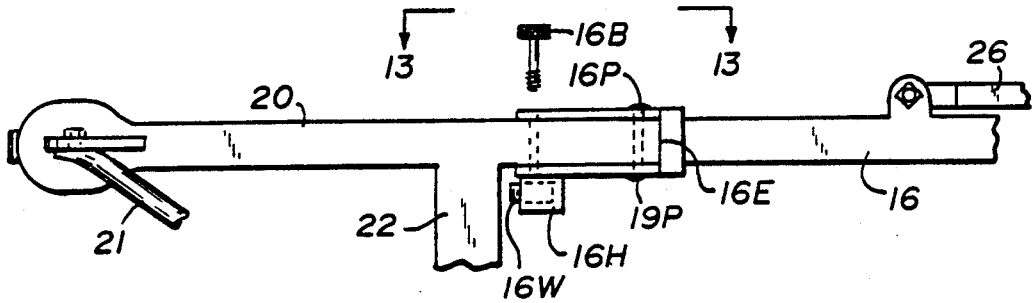
FIG. 11 is a top view of the portion of the lift shown in FIG. 10 as seen from the line 11—11 in FIG. 10.
Figure 12:
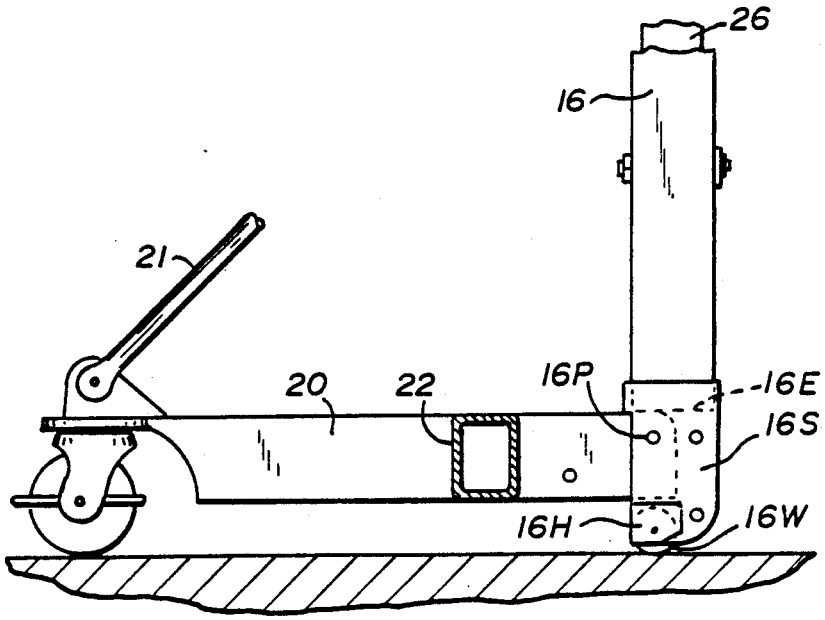
FIG. 12 is a side elevational view similar to that of FIG. 10 but with some parts shown in a moved position.

As best shown in FIGS. 10 and 11, a caster housing 16H and caster wheel 16W are mounted on the sleeve 16S so as to automatically pivot down and rest on the floor or other surface as the member 16 is pivoted to its storage position. Thus, with even one or both members 16, 20 in their storage positions, the lift 10 may still be rolled about as shown in FIG. 14.

To further secure the lift 10 for storage (or for turning on its back), a latch 100, shown best in FIGS. 15 and 16, is provided. The latch 100 comprises a housing 102 secured atop the base cross-member 22 and having a pin 104 which may be received in a conforming sized and shaped hole in the side of the member 57, such that when it is run down to its bottom-most position, the pin 104 may be manually advanced (by knob 106) into it. By thereafter tightening tension on the cable 56 by reeling it in and by locking it by winch 52, not only is the platform 40 secured but also the entire mast assembly 30.

Figure 17:
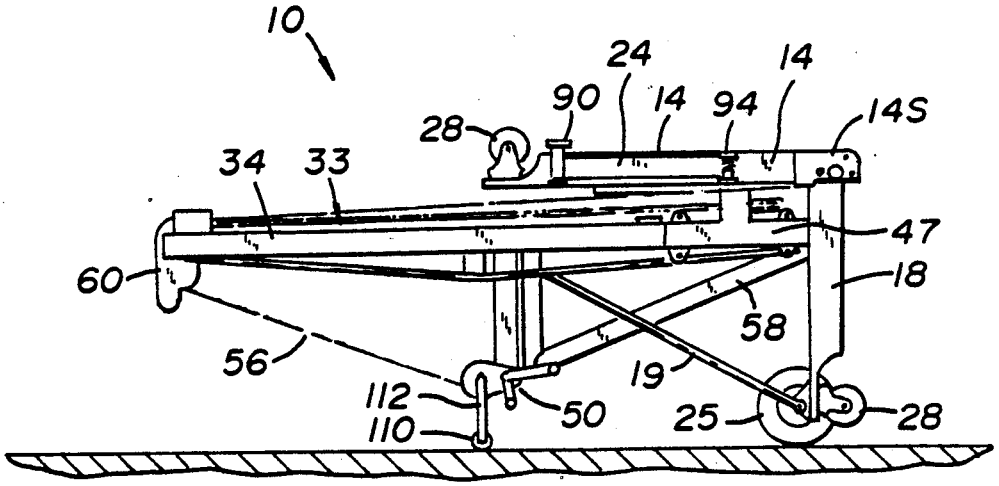
FIG. 17 is a side elevational view of the lift of FIGS. 1–16 in its storage configuration and turned on its back.

As shown in a number of the figures, notably FIGS. 1, 2, 14, and 15, the winch assembly 50 is provided with a roller 110 mounted between two brackets 112 which are secured to the sides of the housing of the winch 52 and projecting rearward. While this roller 110 may serve as a convenient handle for pulling the upright lift, it also, as shown in FIG. 17, serves as a supporting roller when the lift 20 is turned onto its back. As is also made clear from FIG. 17, the wheels 25, 27 and the roller 110 allow the lift 10 to be easily rolled under low obstructions or into, e.g., a panel truck, for movement between jobsites, and allow it to be stored flat or upright. Note should be had of the fact that, when on its back, the center of mass is between the roller 110 and the wheels 25, 27, so that it is relatively easy to lift up the top end and move the roller 110 onto a higher surface such as the bed of a truck.

Extending of Lift Post Assembly

As mentioned above, the lift post assembly 30 may be extended by adding the extension post 32E (FIG. 1) to the assembly. We will now explain how this can be easily accomplished.

First of all, the platform 40 should be secured by the latch 100 and the lift turned on its back, as shown in FIG. 17. (The base members 14, 16 may be in their storage positions, as shown, or if there is space left, extended.) The extension post 32E is removed from its sleeve (to which it is preferably held by a simple latch or screw arrangement). The winch is then released and the housing 60 and its pulleys 62, 64 removed off of the post 32 and attached to the top of the post 32E.

Sufficient cable 56 is fed out to walk the extension post 32E and housing 60 backward of the machine (preferably while keeping some tension on the cable 56, so as to prevent any tangling of the cables) and the bottom of the post 32E inserted in the top of the post 32, in place of the pulley housing. The cable 56 is then winched in to secure the parts together and "send" the housing 60 into the extension post 32E and to seat that post 32E in the post 32. Adjustable support or bracing for the main post 33 is provided by a cable and turnbuckle unit 59, connected from the winch housing to the pulley housing 60. By adjusting the turnbuckle of this unit 59, the lift can be "turned" to compensate for the bending force of differing loads carried on the arms 42, 44. This cable can be easily attached by connecting one end of the cable 59 to the pulley housing 60, and the other end attached as shown to the winch assembly, and the turnbuckle tightened.

Figure 18:
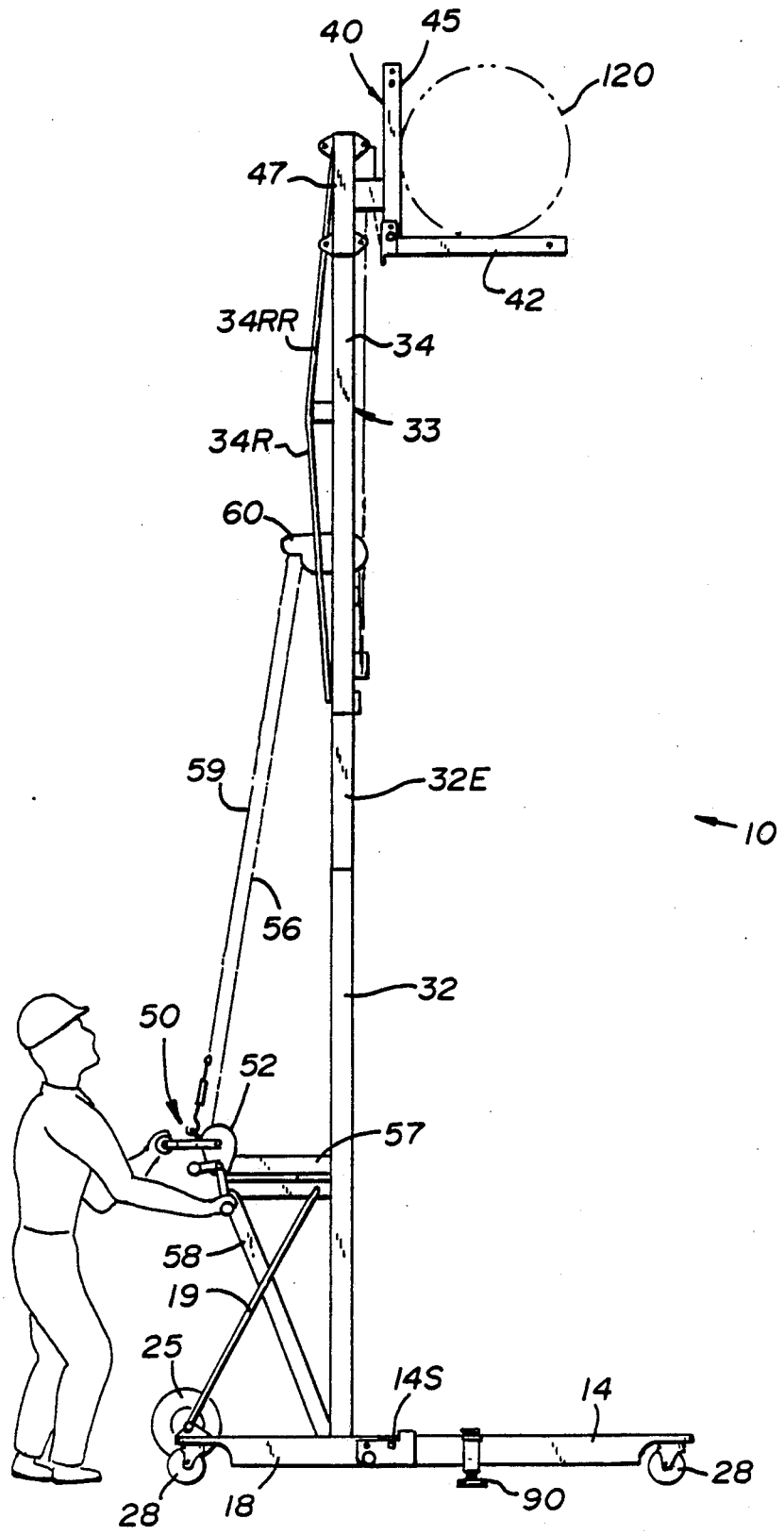
FIG. 18 is a side elevational view of the lift of FIGS. 1–17, shown in its extended configuration with an operator using it to lift a load.

As illustrated in FIG. 18, the lift may now be turned back onto its base 12 and put into its operational configuration and used to reach even higher heights. Note should be made of the fact that, even in the extension configuration of FIG. 18, the platform 40 can be run all the way down to the base 12, just as before, for picking up loads such as the load indicated at 120.

Figure 19:
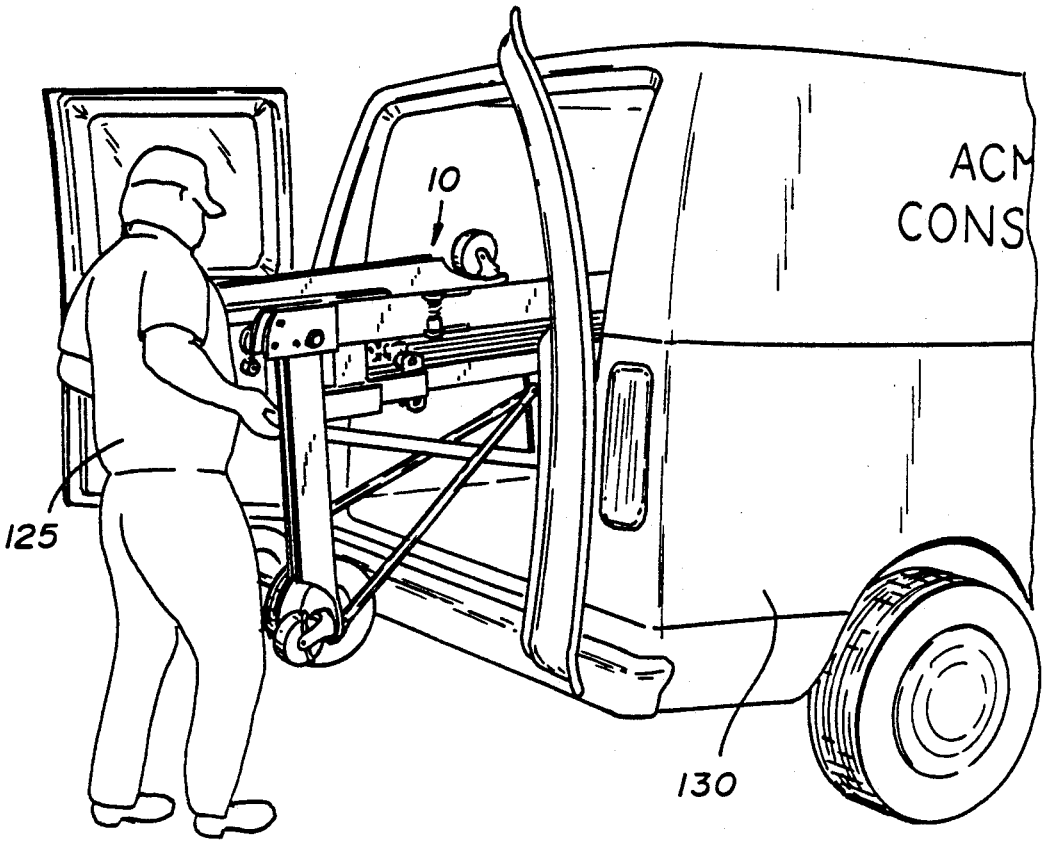
FIG. 19 is a perspective view of the lift of FIGS. 1–18 in its compacted state being loaded into a panel truck by a user.

When the job is done, the lift 10 may be easily returned to its non-extended state by reversing the above process and put in its storage state (FIGS. 14 and 17), and easily moved by one or two men 125 into a panel truck 130, as illustrated in FIG. 19.

For purposes of illustration and not for limitation, the following values and identification are submitted. As will be appreciated by those in this art, many other units, sizes, and materials may be employed, and the inventor himself and his assignee may well decide in the future to vary from these as economics of manufacturing dictate or experience indicates. However, at the present time, these are preferred:

| | |
|---|---|
| | Base |
| Front Rail Members 14, 16 | 2 inches by 4 inches rectangular tubing - 34 inches long - 11 Ga. |
| Caster 28 Cups | Formed 9 Ga. |
| Base Sleeves 14S, 16S | 2 pieces, 8 inches by 4½ inches by ¼ inch, welded in U-shape. |
| Leveler Foot Housing 92 | 1¼ inches by 4 inches, Tube, welded to |
| Leveler Foot 90 | 1 inch by 1 inch by 3½ inches Tube with 1½ inch 00 Pad 1¼ Knurled Knob |
| Outrigger 24, 26 | 1 inch by 3 inches rectangular tubing, 18 inches long - 14 Ga. |
| Bottom Bracket 24G | ¼ inch by 1½ inches by 3 inches with ¾ inch round hole |
| Top Bracket 24F | ¼ inch by 1½ inches by 3 inches with ¾ inch square hole |
| Center Extension Post 32E | 3 inches by 3 inches square tubing - 48 inches long - 11 Ga. with a tongue 2¾ inches by 2¾ inches by 16 inches by 11 Ga. for sleeve for mounting inside up by a |
| Cable 59 | 100 inch guy cable with grab hook and 5/16 turnbuckle |
| Winch | Vermette Needle Roller Bearing Winch |
| Cable 56 | 7/32 inch diameter, 7 × 19 preformed galv. aircraft cable |
| Base 12 | 30½ inches by 70½ inches overall size |
| Rear Side Rails 18, 20 | 2 inches by 4 inches rectangular tubing - 26 inches long - 11 Ga. |
| Cross-Member 22 | 3 inches by 4 inches rectangular tube - 24 inches long - 11 Ga. |
| Center Base Post (bottom section of post 32) | 3 inches by 3 inches - 8 inches long - 11 Ga./ Lean Back 3/16 inch per foot |
| Holder for Extension Post 32E | 3 inches by 3 inches - 8 inches long - 11 Ga., welded on cross-member 22 |
| Hole Strengtheners 16S | 2 inches by ¾ inch by 11 Ga. Tubing, welded in place |
| Platform Lock Down 100 | 1¼ inch cylinder with spring-loaded draw pin |
| Casters 28 | 5 inch casters |
| | Telescoping Section |
| Telescoping Posts 34, 36 | 2 inches by 3 inches by 90 inches long - 11 Ga. |
| Roller 35R, 37 Brackets | ⅜ inch by 1½ inches |
| Rods 34R, 34RR, 36R, 36RR | ⅜ inch round rod |

-continued

| | |
|---|---|
| Front Roller 35R | 1 inch by 3 1/16 inches - 11 Ga. 1012 Roller Bearing, $\frac{3}{4}$ Spacer, $\frac{1}{2}$ inch by 3 inches Bolt and Nut |
| Back Roller 35R | $1\frac{3}{8}$ inches by 1 inch 1012 Roller Bearing and stud and nut |
| Pulley 80 Housing | 11 Ga. Formed |
| Pulley 80 | 4 Inches, 1012 Roller Bearing, Bolt and Nut |
| Pulley 80 Base | Welded, $\frac{3}{8}$ inch by 5 inches |
| Pulley Housing 84 | 11 Ga. Formed |
| Pulley 82 | 5 inches, Roller Bearing, Spacer, and Bolt |
| Pulley 82 Base | Welded, $\frac{3}{8}$ inch by 5 inches |
| Top Pulley and Winch Post | |
| Center Post 32 | 3 inches by 3 inches by 76 inches by 11 Ga. with a sleeve for seating in an 8 section welded to the base, the sleeve being $2\frac{3}{4}$ inches by $2\frac{3}{4}$ inches by 16 inches long - 11 Ga. |
| Winch Blade or Bracket 57 | $\frac{1}{4}$ inch by 5 inches by 11 inches with a Winch Mount $\frac{1}{4}$ inch by 3 inches by $11\frac{1}{4}$ inches with an Eye for Guy Cable unit 59 formed by a $\frac{3}{8}$ inch rod, 9 inches long, U-shaped |
| Winch Brace 58 | $\frac{1}{4}$ inch by $1\frac{1}{2}$ inches by $37\frac{1}{2}$ inches |
| Winch Blade Stiffener 57F | $\frac{1}{4}$ inch by $1\frac{1}{4}$ inches by 3 inches |
| Post Braces 19, 20 | 1 inch thin wall × $38\frac{1}{2}$ inches |
| Platform and its Arms | |
| Upright Members of 47, 48 | 2 inches by 2 inches by 24 inches, 3/16 Wall |
| Extender Members 47H, 48H | 2 inches by 4 inches by 11 Ga. |
| Side Members 43, 45 | 2 inches by 3 inches by 11 Ga. |
| Rollers 40R - Brackets | $1\frac{1}{2}$ inches by 6 inches by $\frac{3}{8}$ inch |
| Cross-Member 46 | 2 inches by 4 inches by $17\frac{1}{2}$ inches by 11 Ga. |
| Rollers 40R | $1\frac{3}{8}$ inches by 1 inch With 1012 Bearing, Stud, and $\frac{3}{8}$ inch NF Nut |
| Fork or Arms | 2 inches by 2 inches by 26 inches by 11 Ga. |
| Fork Sleeves or Braces 42S | 2 pieces, 2 inches by 7 inches by $\frac{1}{4}$ inch<br>1 piece, 2 inches by 9 inches by $\frac{1}{4}$ inch<br>Welded in U Shape |
| Pulley 80 | 4 Inch Pulley with Bearing, Spacer, and $\frac{1}{2}$ inch Bolt |
| Pulley 80 Mount | 4 inches by $6\frac{1}{4}$ inches - 11 Ga. |
| Pulley 80 Cover | 4 inches by $5\frac{1}{2}$ inches - 11 Ga. |

All parts are of steel construction except as indicated to the contrary. The prototype is currently designated as Vermette Model 758T Lift with a rated capacity of 750 (and a breaking capacity of 3,000) pounds. Its lifting height with the forks or arms 22, 24 down without the extension post is 12 feet, 5 inches, and with them up, it is 16 feet, 5 inches. With the arms 42, 44 in their high or up position on the platform, the lifting heights are 14 feet, 5 inches without the extension and 18 feet, 5 inches with it.

This unit has a compacted size of 97 inches in height, $31\frac{1}{2}$ inches in width, and $36\frac{1}{2}$ inches long. When fully extended with the extension post in place, it is 18 feet, 6 inches high, $70\frac{1}{4}$ inches wide, and 74 inches long. This remarkably versatile steel unit weighs in at only 388 pounds—and because of its design and balance, this machine can be handled, set up, compacted, and placed into a van by one man.

While one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

I claim:

1. In a portable lift, for being positioned on a working surface or floor, comprising:

a base unit having contacting means for contacting the working surface or floor;

a post assembly mounted on said base unit and having a front and back side;

a platform unit mounted to move up and down the front side of said post assembly;

a winch mounted to said base and post assembly combination at the back side of said post assembly and including a winch cable which is coupled to move said platform unit;

said base including extension rails which project in front of said post assembly; the improvement of:

having said extension rails pivotably secured to the rest of said base at a position just in front of said post assembly, so as to be pivotable upward from an operational horizontally extended position just above the working surface or floor to a vertical storage position wherein they are generally parallel to the post assembly;

means for releasably securing the extension rails in said operational position and alternatively in said storage position; and a wheel mounted on each of said pivotable extension rails, so as to pivotably move downward a short distance from a storage position above and out of contact with the working surface or floor to an operational position in which said wheel contacts the operational position in which said wheel contacts the working surface or floor and aids in supporting said base on the working surface or floor as said rail is pivoted upward from its operational position to its storage position.

2. A mechanical portable lift, comprising:

a base;

a post assembly mounted on said base;

a platform unit mounted to move up and down said post assembly;

a winch having a cable mounted to the lift so as to raise said platform on said pivot assembly and allow it to be lowered thereon;

said platform having an upper section and a lower section and a pair of removable projecting arms, said sections and said arms including means for attaching each of said arms to said sections so as to alternatively have each of said arms attached to said platform to project out from said upper section of said platform or from said lower section of said platform or to be attached to said platform in a storage position wherein the arm does not substantially project out from the platform.

3. The lift of claim 2, wherein: said arms each have an elongated arm and a channel projection at one end thereof, and said platform has a conformingly-shaped upper and lower member for receiving said channel projections in a loose fit, with said arms respectively seated above or below the upper and lower members and said channel projections also fitting over the upper member when the arm is in its storage position, said channel projection and said upper and lower members having holes so aligned that a member may be passed through them when so positioned, and said platform unit including a member for each arm for passing through the aligned holes and releasably securing the arms to the platform unit.

4. A compactable portable mechanical lift for use on a surface for lifting loads, comprising:

a base having longitudinally-extending rail members each having a forward section and having caster wheels at the ends of said rail members which allow the base to roll over the surface;

outriggers mounted to said longitudinally-extending rails which can be moved from a storage position adjacent to said forward section of said rails to an operational position extended from the rails, at which position said outriggers can contact the surface to stabilize the lift;

a post assembly, having a front and a back, mounted centrally on said base, said base and mounted post assembly being, with said outriggers in their storage positions and post assembly not extended less than a standard door opening in height and width so as to easily roll through such openings;

a winch assembly including a manually-powered winch and a winch cable connected thereto mounted to the lift at the back of the post assembly;

a platform having projecting arms for carrying a load, said platform being mounted to move up and down said post assembly, said platform being coupled to said winch cable so that manual operation of said winch results in the movement of said platform, its arms, and any load thereon;

wheel means mounted to said lift at its back so as to allow the lift to be turned on its back and rolled about the surface on said wheel means, wherein the forward sections of the longitudinal rail members of said base are pivotably mounted so that they may be folded up parallel to the post assembly and secured in that storage position;

said outriggers are pivotably mounted to said forward sections forward of said base and under said projecting arms when operationally positioned and when in their storage positions are folded up with said sections; and said projecting arms are releasably secured to said platform and may be secured thereto in a storage position wherein they do not substantially project from the front of the platform;

whereby said lift with its forward sections of the longitudinal rail members in said storage positions and said arms secured and said outriggers pivoted into their storage positions has a clearance small enough when placed on its back and rolled into and contained by a standard van or panel truck.

5. The lift of claim 4, wherein:

a wheel is mounted on each of said pivotable extension rails, so as to move from a storage position to an operational position as said rail is pivoted from its operational position to its storage position.

6. The lift of claim 4, wherein: said arms each have an elongated arm and a channel projection at one end thereof, and said platform has a conformingly-shaped upper and lower member for receiving said channel projections in a loose fit, with the arm sections respectively seated above or below the upper and lower members and said channel projection also fitting over the upper member when the arm is in its storage position, said channel projection and said upper and lower members having holes so aligned that a member may be passed through them when so positioned, and said platform unit including a member for each arm for passing through the aligned holes and releasably securing the arms to the platform unit.

7. The lift of claim 4, wherein said outriggers include:

an automatic latch mechanism which, when released, allows the outrigger to be easily pivotably displaced between its storage position and its operational position, but which automatically relatches the outrigger in either of said positions as it reaches that pivotable position; and wherein said mechanism includes a pin which also serves as a pivot pin for pivotably connecting the outrigger to the base; means for mounting said pin for axial displacement between two positions; mechanical bias means biasing the pin toward one of said positions; non-circular opening formed in the means for mounting said pin, into which said pin may enter when the outrigger is in its operational position or storage position but not when it is pivoting between such positions.

* * * * *

UNITED STATES PATENT AND TRADEMARK OFFICE

CERTIFICATE OF CORRECTION

PATENT NO. : 4,987,976

DATED : January 29, 1991

INVENTOR(S) : Andrew H. Daugherty

It is certified that error appears in the above-identified patent and that said Letters Patent is hereby corrected as shown below:

Column 4, line 42, after "handle", change "54S" to --54K--.

Signed and Sealed this

Twenty-eighth Day of July, 1992

*Attest:*

DOUGLAS B. COMER

*Attesting Officer*

*Acting Commissioner of Patents and Trademarks*